US007383900B2

(12) United States Patent
Zijsling

(10) Patent No.: US 7,383,900 B2
(45) Date of Patent: Jun. 10, 2008

(54) DRILL BIT AND SYSTEM FOR DRILLING A BOREHOLE

(75) Inventor: Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 1 day.

(21) Appl. No.: 10/557,525

(22) PCT Filed: May 19, 2004

(86) PCT No.: PCT/EP2004/050856

§ 371 (c)(1),
(2), (4) Date: Nov. 18, 2005

(87) PCT Pub. No.: WO2004/104361

PCT Pub. Date: Dec. 2, 2004

(65) Prior Publication Data

US 2007/0039760 A1 Feb. 22, 2007

(30) Foreign Application Priority Data

May 21, 2003 (EP) ..... 03076532

(51) Int. Cl.
*E21B 10/32* (2006.01)

(52) U.S. Cl. ..... 175/267; 175/266; 175/287

(58) Field of Classification Search ..... 175/267, 175/287, 266
See application file for complete search history.

(56) References Cited

U.S. PATENT DOCUMENTS

| | | | | |
|---|---|---|---|---|
| 2,238,377 A * | 4/1941 | Strang | ..... | 175/291 |
| 2,822,150 A | 2/1958 | Muse et al. | ..... | 255/76 |
| 3,208,540 A | 9/1965 | Park | ..... | 175/269 |

FOREIGN PATENT DOCUMENTS

| | | |
|---|---|---|
| GB | 2320270 | 6/1998 |
| GB | 2365888 | 2/2002 |

OTHER PUBLICATIONS

Intl Search Report dated Sep. 14, 2004 (PCT/EP2004/050856).
Intl Preliminary Report on Patentability (PCT/EP2004/050856).

* cited by examiner

*Primary Examiner*—Giovanna C Wright

(57) ABSTRACT

A drill bit for drilling a borehole in an object, the drill bit having a central longitudinal axis and comprising a bit body provided with a central shank for connecting the drill bit to a drilling system. The drill bit further comprises at least one cutting arm, each cutting arm being provided with a set of cutters for cutting the object and being coupled to the bit body allowing the cutting arm to pivot between a radially retracted position and a radially expanded position.

11 Claims, 3 Drawing Sheets

DRILL BIT AND SYSTEM FOR DRILLING A BOREHOLE

The present application claims priority on European Patent Application 03076532.5 filed May 21, 2003.

FIELD OF THE INVENTION

The present invention relates to a drill bit for drilling a borehole in an object, the drill bit comprising a bit body extending around a central longitudinal axis, the drill bit being operable by rotation about the central longitudinal axis.

BACKGROUND OF THE INVENTION

An expandable drill bit is known and disclosed in published patent application GB 2 365 888 A. The known drill bit comprises two pivotable arms provided with cutters. In retracted position the arms cut a bore which clears the bit body, and in expanded position they cut a wider bore. In the expanded position a pilot section cuts the center of the borehole, and the arms cut the gauge.

SUMMARY OF THE INVENTION

The present inventions include a drill bit for drilling a borehole in an object, the drill bit having a central longitudinal axis and comprising a bit body provided with a central shank for connecting the drill bit to a drilling system, the drill bit further comprising at least one cutting arm, each cutting ann being provided with a set of cutters for cutting the object and being coupled to the bit body via pivot means allowing the cutting arm to pivot between a radially retracted position and a radially expanded position, the drill bit being provided with support means for supporting the cutting arm in the radially expanded position thereof, wherein the support means is arranged to transmit at least a portion of the rotational torque generated during dulling, from the cutting arm to the bit body so as to reduce or prevent transmission of said rotational torque via the pivot means.

BRIEF DESCRIPTION OF THE DRAWINGS

The embodiments of invention will be described hereinafter in more detail and by way of example with reference to the accompanying drawings in which.

DETAILED DESCRIPTION OF THE INVENTION

Figure 1:
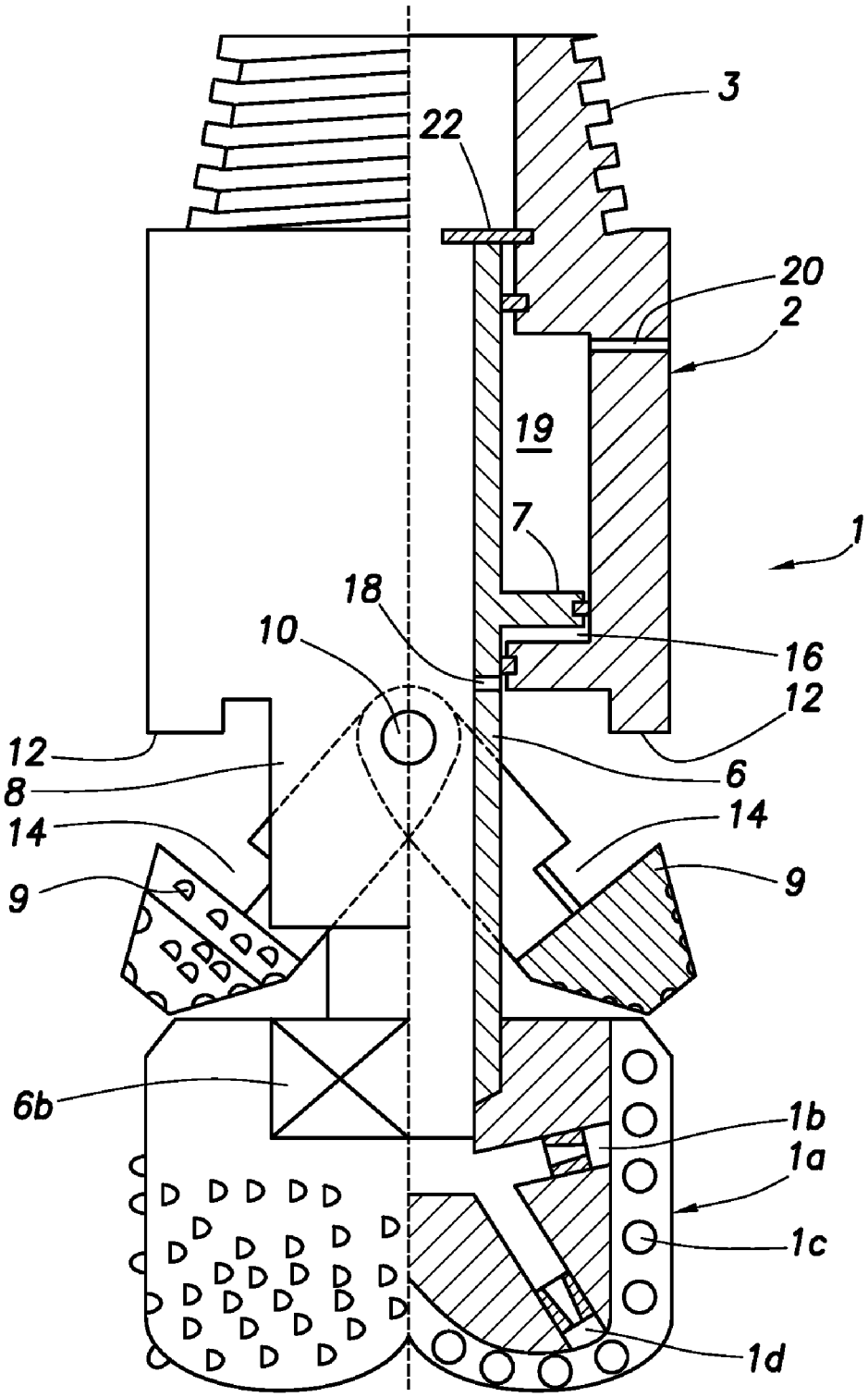
FIG. 1 schematically shows a longitudinal view, partly in section, of an embodiment of the drill bit of the invention when in radially retracted position.

In the Figures like reference numerals relate to like components.

Figure 2:
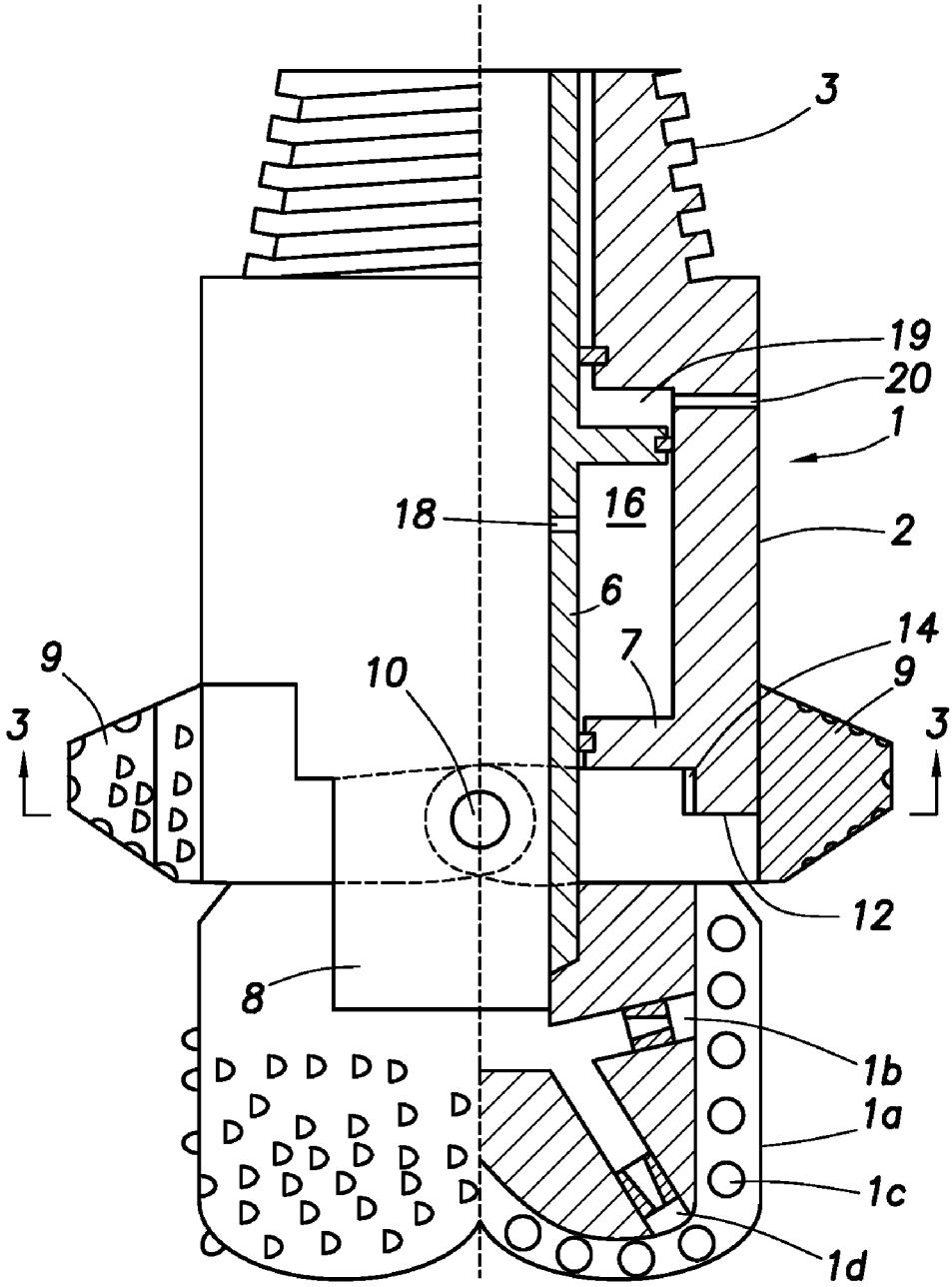
FIG. 2 schematically shows a longitudinal view, partly in section, of the drill bit of FIG. 1 when in radially expanded position.
Figure 3:
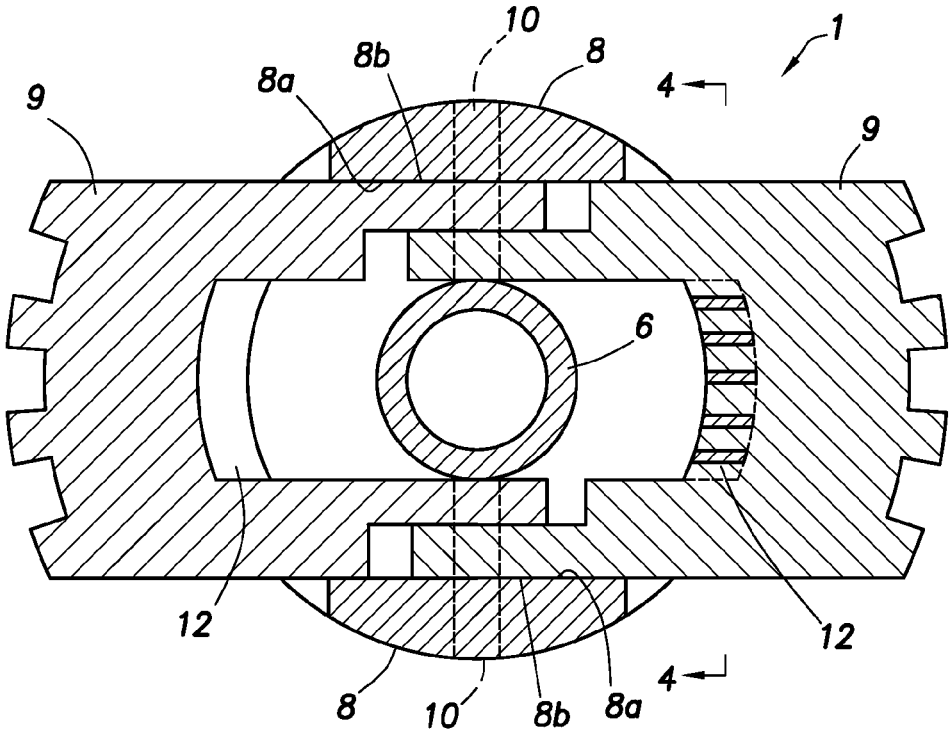
FIG. 3 schematically shows cross section 3-3 of FIG. 2.

Referring to FIGS. 1-3 there is shown a drill bit 1 for drilling a borehole into an earth formation, the drill bit having a pilot section 1*a* provided with fluid nozzles lb and a cutting structure 1*c* similar to the cutting structure of a regular drill bit. Pilot section 1*a* is of a diameter slightly smaller than the pass-through diameter of an entry part of the borehole, for example as defined by a casing tube (not shown) present in an upper part of the borehole. Furthermore, the drill bit has a shank 2 provided with a thread 3 to connect the drill bit to a drill string (not shown). The pilot section l*a* is fixedly connected to a tube 6 which is axially slidably received in the shank 2, the tube 6 being equipped with a piston 7. Thus the pilot section 1*a*, the tube 6 and the piston 7 can axially slide relative to the shank 2. The shank 2 is provided with two opposite lips 8, each lip 8 having a flat inner surface 8*a*(FIG. 3) extending against a corresponding flat outer surface 8*b* of the pilot section 1*a* when the pilot section 1*a* is in the uppermost position relative to the shank 2 (FIG. 2).

Figure 4:
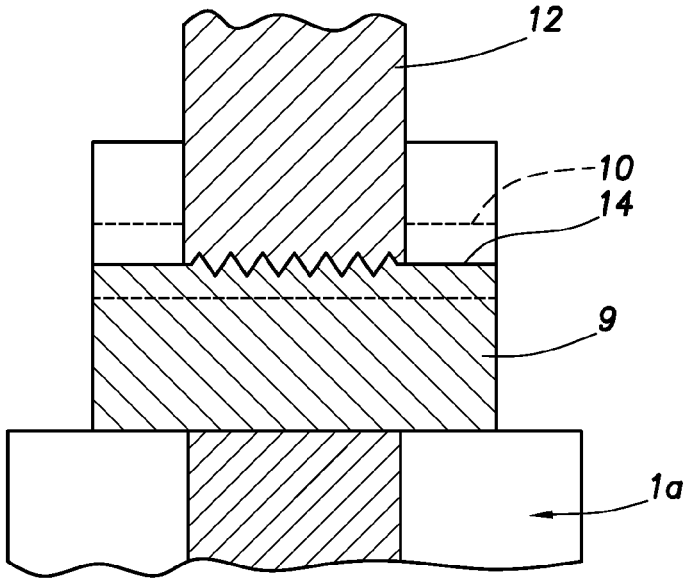
FIG. 4 is a partial cross-sectional view taken along the lines 4-4 in FIG. 3.

The drill bit 1 is further provided with cutting arms in the form of under-reaming arms 9 connected to the shank 2 via pivot means in the form of hinges 10 supported by the lips 6. Each under-reaming arm 9 is rotatable around a respective hinge 10 between a radially retracted position in which the under-reaming arm 9 is substantially flush with the pilot section 1*a*, and an expanded position in which the under-reaming arm 9 extends to a larger diameter than the pilot section 1*a*. The shank 2 is at the lower end thereof provided with an annular lock-ring 12 which snugly fits in a corresponding annular groove 14 provided at each under-reaming arm 9 when the arm 9 is in its radially expanded position. Furthermore, the lock-ring 12 and the grooves 14 are provided with teethed profiles (shown in FIG. 4) so as to allow the cutting torque generated during operation of the drill bit 1 to be transmitted from the under-reaming arm 9 to the shank 2 via said teethed profiles. Instead of a teethed profile, any suitable profile can be provided to the lock-ring 12 and the grooves 14 to transmit loads and torques between the arms 9 and the shank 2, for example a stepped profile.

The piston 7 defines two annular chambers in the shank 2, whereby a chamber 16 below the piston is connected to the bore of the tube 6 via a port 18. This port 18 is closable by the shank 2 when the piston 7 is in its lowermost position. A chamber 19 above the piston 7 is connected to the wellbore annulus (not shown) formed between the drill bit 1 and the borehole, via port 20. When a drilling fluid is circulated through the bit 1, the pressure drop across the fluid nozzles 1*b* causes a net upward force on the tube 6 because the annular piston area is larger than the area of the tube 6.

In case the two under-reaming arms 9 are symmetrical, the bit 1 has a force balanced cutting structure for any position of the arms 9. The outer surface of the lips 8 of the shank 2 can be provided with a wear resistant layer to provide additional lateral stabilization of the bit.

When drilling an over gauge hole with a casing in an earth formation, the running procedure is as follows:

The bit 1 is run through the casing with the pilot section 1 axially extended from the shank 2 and the under-reaming arms 9 in their respective retracted positions (as shown in FIG. 1). The pilot section 1*a* is kept in the axially extended position by means of a shear pin 22 provided in the shank 2, which prevents upward movement of the tube 6 in the shank 2. The drill bit 1 is further run into the open hole underneath the casing to enable the drilling assembly to be locked in the lower part of the casing. Then the casing with drilling assembly is run to the bottom of the hole. During this operation mud circulation is possible without activating the under-reaming arms 9 because the port 18 in tube 6 is closed by the shank 2 when the piston is in lowest position. Once the pilot bit tags the bottom of the hole, the tube 6 is moved upwards relative to the shank, thereby breaking the shear pin 22, whereafter port 9 opens. The pressure drop across the bit nozzles will tend to close the bit. By closing the bit the under-reaming arms 9 will move outwards, and end up in their expanded position such as is schematically depicted in FIG. 2.

Still referring to FIG. 2, when the arms 9 are in fully expanded position the lips 8 of the shank 2 snap around the flat outer surfaces 8*b* of the pilot section 1*a*. At the same time the lock-ring 12 at the lower end of the shank 2 snaps in the grooves 14 in the under-reaming arms 9. The cooperating lock-ring 12 and the grooves 14 of the under-reaming arms 9 prevent rotation of the arms 9 relative to the shank 2 in the direction of rotation of the bit.

Once the pilot bit is in its upward most position, resulting in the under-reaming arms 9 being in their fully expanded position, the drilling torque of the pilot bit is transmitted via the lips 8 to the shank 2 and subsequently to the drilling assembly via the threaded connection 3. The weight on the pilot section 1*a* is transferred via the under-reaming arms 9 and the lock-ring 12 to the shank 2 and subsequently via the threaded connection 3 to the drilling assembly. The weight on the under-reaming arms 9 is transferred via the lock-ring 12 to the shank 2 and the torque of the under-reaming arms 9 is transferred via the teethed sections of the lock-ring 12 to the shank.

Thus, once the arms 9 are in expanded position the expansion mechanism is not exposed to the drilling loads which makes the bit very robust. In fact, the object experiences the expanded bit like a single piece solid bit body.

The drill bit can also be used to drill-out the previous casing shoe provided with a bell, or drilling-out of a previous casing shoe as part of conventional casing drilling operations.

In this case the procedure is as follows. After the drilling assembly is locked in the casing, the casing is run into the cased hole until the top of the cement is tagged. Then port 18 is open by a movement of the pilot section 1*a* upwards relative to the shank 2. Upon circulation of the drilling fluid, such as mud, an axial contraction force is applied and the bit tends to close thereby pushing the under-reaming arms 9 outwards. During rotation of the bit the under-reaming arms 9 will open the hole until the cutting elements on the under-reaming arms 9 contact the steel of the previous casing installed already. These cutting elements should be designed such that they do not cut steel. This can be achieved for instance by using cutting elements with large negative rake angle similar to that applied for bi-centre bits.

While drilling out the cement from the casing shoe the under-reaming arms 4 scrape the cement from the inner wall of the installed casing or the bell area of the installed casing.

Once the under-reaming arms 4 extend into the open hole below the previous casing the cutting structure will enable the hole to be opened up further to enable the arms 9 to reach their fully expanded position as shown in FIGS. 2 and 3.

A design feature required for drilling-out of the casing shoe is that the pilot section 1*a* is lockable in bit rotation direction relative to the shank 2 of the bit for any position of the piston 7. This can be achieved by extending the length of the lips 8 and the size of the flat sections 8*b* at the gauge of the pilot section 1*a* so that they are engaged at all times. Alternatively the top part of tube 6 can be equipped with splines that slide in the top part of the shank 2 as to prevent rotation of the pilot section 1*a* relative to the shank 2.

During the drilling-out of a casing shoe the drilling torque from the under-reaming arms 4 is transferred to the shank 2 via the hinges 10. Alternatively the interface between the under-reaming arms and the pilot section can be equipped with radial slots which transmit the torque from the arms to the shank.

In summary, the invention provides an expandable bit, which can drill in several positions. In expanded position the under-reaming arms are locked in place by a hydraulic force. Once the arms are locked the drilling forces including the torque on bit and/or the Weight on Bit are transmitted directly from the cutting elements to the shank of the bit thereby unloading the hinges of the under-reaming arms. This way the bit is seen by the formation as a regular bit with a potential drilling capability similar to that of regular bits as well. This feature combined with the appropriate cutting structure on the under-reaming arms 4 should make the drill bit suitable for a wide range of formations including the harder rocks.

By virtue of the provision of the support means, the pivot means is relieved from taking the full torque load. It is thereby achieved that the pivot means is less vulnerable to damage due to transmission of high loads, without loosing reliability of switching the drill bit from the retracted to the expanded position and vice versa.

In another aspect, the invention provides a hydraulic system for driving a pivoting movement of a pivotable tool arm between a radially retracted position and a radially expanded position, the hydraulic system comprising a cylinder and piston means slidably arranged in the cylinder forming a drive chamber on one side of the piston means and a return chamber on the other side of the piston means, the piston means having a forward and a rearward position in the cylinder whereby the piston means is activatable to its rearward position by causing the drive force acting on the piston as a result of pressure in the drive chamber to exceed the return force acting on the piston as a result of pressure in the return chamber, which piston means is coupled to the pivotable tool arm for driving the tool arm from the retracted position to the expanded position when the piston is driven into its rearward position, whereby the piston means is coupled to gate means with is arranged such that the return force acting on the piston as a result of pressure in the return chamber exceeds the drive force acting on the piston as a result of pressure in the drive chamber when the piston means is in or near its forward position whereas the opposite is the case when the piston means is in a position other than in or near its forward position.

When the tool arm is in its retracted position, the piston means can be positioned in or near its forward position where the gate means is switched such as to bias the piston means to its forward position. When the piston means is mechanically moved out of its forward position, the gate means is switched because it is coupled to the piston means, which results in the drive force acting on the piston as a result of pressure in the drive chamber exceeding the return force acting on the piston as a result of pressure in the return chamber. Consequently, the tool arm is pivoted to its expanded position and held in that position by the piston means. The starting situation, whereby the piston means is again biased in its forward position can be restored by mechanically forcing the piston means to its forward position, or by provision of additional gate means for regulating the pressures inside the drive chamber and return chamber such as to move the piston means forward on command.

Among other features that may be included in the drill bit are:

A gripping device for locking the tube once the arms have reached the fully expanded position by hydraulic actuation via the piston and tube. This way the bit is locked in expanded position. At the end of a bit run the bit can be collapsed by pulling the drilling assembly into the casing again. This pulling force should enable shear pins that hold the gripping device to fail so that the tube is released again and the bit opens and the under-reaming arms can move to the retracted position.

Nozzles can be put in the pilot section of the bit in such a way that the jets out of these nozzles point towards the under-reaming arms to provide effective cleaning and cooling.

The expandable bit can also be used for conventional over gauge drilling with drill pipe rather than casing. In this case the shank of the bit is preferably provided with water ways to enable mud to be circulated while the arms are in retracted position.

Multiple sets of under-reaming arms can be included in the above described hydraulic locking-mechanism.

The hydraulic locking mechanism described above can be applied in a more general sense as well to achieve a specific functionality of other expandable down hole components, such as expandable stabilisers for application in over gauge drilling.

We claim:

1. A drill bit for drilling a borehole in an object, the drill bit having a central longitudinal axis and comprising a bit body provided with a central shank for connecting the drill bit to a drilling system, the drill bit further comprising at least one cutting arm, each cutting arm being provided with a set of cutters for cutting the object and being coupled to the bit body via pivot means allowing the cutting arm to pivot between a radially retracted position and a radially expanded position, the drill bit being provided with support means for supporting the at least one cutting arm in the radially expanded position thereof, wherein the support means is arranged to transmit at least a portion of the rotational torque generated during drilling from the at least one cutting arm to the bit body so as to reduce or prevent transmission of said rotational torque via the pivot means, wherein the support means is arranged to transmit axial loads from the cutting arm to the bit body when the at least one cutting arm is in the radially expanded position, wherein the support means comprises an axial end surface on the bit body, for transmitting said axial loads from the at least one cutting arm to the bit body, and said axial end surface includes a profile configured to transmit a portion of said rotational torgue from the cutting arm to the bit body.

2. The drill bit of claim 1, wherein the support means is further arranged to transmit an axial compressive load from the at least one cutting arm to the bit body.

3. The drill bit of claim 1, wherein the support means is further arranged to support a radial compressive load from the at least one cutting arm to the bit body.

4. The drill bit of claim 1, wherein the support means is arranged to transmit a majority of the rotational torque, preferably essentially the full rotational torque, from the at least one cutting arm to the bit body.

5. The drill bit of claim 1, further comprising a pilot section provided with pilot cutters arranged for pre-cutting a pilot borehole ahead of the at least one cutting arm.

6. The drill bit of claim 5, wherein the pilot section is axially movable with respect to the shank whereby the at least one cutting arm is coupled to the pilot section for controlling the pivoting of the at least one cutting arm.

7. The drill bit of claim 6, wherein the pilot section is coupled to a hydraulic system for controlling said axial movability.

8. The drill bit of claim 1 wherein the drill bit is a drill bit for drilling a borehole in an earth formation.

9. The drill bit of claim 1 wherein said profile includes teeth.

10. The drill bit of claim 1 wherein said profile includes a stepped profile.

11. The drill bit of claim 1 wherein said cutting arm does not engage said profile when said cutting arm is not in said radially expanded position.

* * * * *